US006948743B1

(12) United States Patent
Peterson

(10) Patent No.: US 6,948,743 B1
(45) Date of Patent: Sep. 27, 2005

(54) MULTILAYER LABEL AND METHOD OF MAKING THE SAME

(75) Inventor: Todd A. Peterson, Clearwater, FL (US)

(73) Assignee: Weber Marking Systems, Arlington Heights, IL (US)

( * ) Notice: Subject to any disclaimer, the term of this patent is extended or adjusted under 35 U.S.C. 154(b) by 207 days.

(21) Appl. No.: 10/336,478

(22) Filed: Jan. 3, 2003

(51) Int. Cl.[7] ..... B42D 15/00
(52) U.S. Cl. ..... 283/94; 283/81; 283/101; 428/42.3
(58) Field of Search ..... 283/81, 94, 101, 283/109; 428/40.1, 42.1, 42.3

(56) References Cited

U.S. PATENT DOCUMENTS

| | | | | |
|---|---|---|---|---|
| 4,744,161 | A | 5/1988 | Instance | |
| 5,021,273 | A | 6/1991 | Kobayashi | |
| 5,207,458 | A | 5/1993 | Treichel et al. | |
| 5,234,735 | A | 8/1993 | Baker et al. | |
| 5,264,265 | A | 11/1993 | Kaufmann | |
| 5,284,363 | A | 2/1994 | Gartner et al. | |
| 5,290,616 | A | 3/1994 | Cowan et al. | |
| 5,403,636 | A | 4/1995 | Crum | |
| 5,597,634 | A * | 1/1997 | Bloomer et al. | 428/40.1 |
| 5,700,537 | A | 12/1997 | Instance | |
| 5,727,819 | A | 3/1998 | Grosskopf et al. | |
| 5,738,382 | A * | 4/1998 | Grosskopf et al. | 283/81 |
| 5,804,271 | A * | 9/1998 | Barry | 428/40.1 |
| 5,866,219 | A | 2/1999 | McClure et al. | |
| 5,910,349 | A * | 6/1999 | Tsukuda | 428/42.3 |
| 5,972,455 | A * | 10/1999 | Barry | 428/40.1 |
| 5,975,582 | A * | 11/1999 | Treleaven | 283/81 |
| 6,037,029 | A | 3/2000 | Instance | |
| 6,057,019 | A | 5/2000 | Barry | |
| 6,150,035 | A * | 11/2000 | DeFife et al. | 428/500 |
| 6,179,335 | B1 | 1/2001 | DeLise, Jr. | |
| 6,254,137 | B1 | 7/2001 | Baum, Jr. et al. | |
| 6,398,263 | B2 | 6/2002 | Treleaven et al. | |
| 6,413,345 | B1 | 7/2002 | Treleaven | |
| 6,413,604 | B1 | 7/2002 | Matthews et al. | |
| 6,447,862 | B1 | 9/2002 | Rankin et al. | |

OTHER PUBLICATIONS

Copy Order Sheet for new order No. 63797 dated Nov. 6, 2000.
Order specification under ACI filing No. 13353-101 dated Nov. 6, 2000.
Packing list No. 38633 (accounting copy) showing shipping date of Nov. 9, 2000 for order No. 63797.

(Continued)

*Primary Examiner*—Monica S. Carter
(74) *Attorney, Agent, or Firm*—McDermott Will & Emery LLP

(57) ABSTRACT

A multiple layer label and a method of making the same are provided. Specifically, a label having a base layer for adhering to a container is provided wherein the label has an overcoat layer having an end that is removably adhered to the container. Moreover, the end that is removably adhered to the container is grasped by a user of the label and pulled, thereby removing the end of the overcoat layer from the container and swinging the layer away from the remainder of the label and exposing sublayers beneath the overcoat layer. The overcoat layer is adhered directly to the base layer, and at least portions of the sublayers. Each of the overcoat layer, sublayers, and the base layer may have indicia printed thereon for communicating information.

31 Claims, 9 Drawing Sheets

OTHER PUBLICATIONS

Proforma invoice No. 110900, paid in full by check No. 012913 in the amount of $8,500.00.
Straight bill of lading dated Nov. 10, 2000.
Accounting copy of order No. 63797, dated Nov. 13, 2000.
Ampersand Label, Inc. invoice No. 43927 dated Nov. 14, 2000.
Letter dated Aug. 21, 2003 from David S. Stallard of Wood, Herron & Evans, L.L.P. to Mr. Brad Weber of Weber Marketing Systems, Inc.
Letter from Lowell F. Matthews to Bill Teefy dated Jul. 17, 2003 (3pp).
Letter from Brad Weber to Lowell F. Matthews dated Aug. 5, 2003. (1pp).

* cited by examiner

MULTILAYER LABEL AND METHOD OF MAKING THE SAME

FIELD OF THE INVENTION

The present invention relates to a multiple layer label and a method of making the same. Specifically, the present invention provides a label having a base layer for adhering to a container, such as a bottle containing a product, wherein the label has an overcoat layer having an end that can be removably adhered to the container. Moreover, the end that is removably adhered to the container may be grasped by a user of the label and pulled, thereby removing the end of the overcoat layer from the container and swinging the layer away from the container and exposing sublayers beneath the overcoat layer. The sublayers and the base layer are directly adhered to the overcoat layer. Each of the overcoat layer, sublayers, and the base layer may have indicia printed thereon for communicating information to a user of the label, container, product contained within the container, or any other information.

BACKGROUND OF THE INVENTION

Labels disposed on containers for communicating information to consumers are, of course, generally known. The information typically relates to instructions on how to use the container or how to use the product contained therein. Labels are typically adhered to the containers using an adhesive on a side of the label, whereupon the label is pressed to the container.

Various multiple layer labels of different construction from the present label are known. The multiple layer labels are typically used to provide additional information to a consumer that would otherwise not fit within the four corners of a single layer label. A multiple layer label may have panels, subpanels, sublayers, or pages between a top panel of the label and a base layer of the label. Alternatively, a multiple layer label may merely have a top layer and a base layer, whereupon information is provided on a top surface of the base layer and/or a bottom surface of the top layer. Upon removal of the top layer of the label, the panels, subpanels, sublayers, pages, or top surface of the base layer may be typically exposed, thereby communicating to a user of the multiple layer label the information. Alternatively, panels are typically provided that may be removed from the remainder of the label. These panels may contain coupons, instructions, or any other information.

The known prior art labels adhered to products, such as bottles or other containers. However, these prior art labels generally have multiple layers contained between a base layer and an overlay layer, wherein the multiple layers are folded, or otherwise provided in a booklet form. This introduces unnecessary complexity to the label, in that the internal layers must be folded and/or bound in such a way as to allow the multiple layers to be opened like a booklet. In addition, the folded area of the inner layers are bulky and difficult to make flat, so that the fold or folds extend away from the base layer, thereby not allowing the label to be disposed as flat as possible against the surface of the container. Further, prior art labels typically are difficult to remove from the containers and the top layers are typically difficult to fold out the top portions from the container, thereby providing access to the internal layers of the label.

Therefore, a multilayer label is necessary that solves the problems identified above, including a label system that decreases the complexity of the label system and allows the label to be applied flat against the container. In addition, a method of making the label system is necessary to create a label system that is less complex and easy to produce, thereby producing a label system that is easy to open to access the information contained therein.

SUMMARY OF THE INVENTION

The present invention relates to a multilayer label system having a base layer, an overcoat layer, and a plurality of internal sublayers. The overcoat layer may be a clear polymeric material that protects the base layer and the plurality of internal layers. A first internal sublayer is directly adhered to the overcoat layer at a first portion of the overcoat layer, wherein a second portion of the overcoat layer is adhered to the base layer. Further, the overcoat layer extends beyond the base layer at an edge to directly and removably adhere to the container. Each internal sublayer is slightly longer that the internal layer disposed immediately above, when viewing the multilayer label from above, so that each internal layer may have a portion that is adhered to the overcoat layer. The base layer has an adhesive to adhere the base layer to the container.

It is, therefore, an advantage of the present invention to provide a multilayer label that includes a plurality of internal sublayers such that, when a first layer is removed or swung away from the remainder of the label, the internal layers are exposed. This allows the label to have much more space for providing information, such as directions, pictures, coupons, or any other type of information, to a user of the label.

Further, it is an advantage of the present invention to provide a multilayer label that can be adhered to a container to provide a user of the container with information relating to the container and/or a product contained within the container.

Moreover, it is an advantage of the present invention to provide a removable tab on an overcoat layer of the multilayer label wherein the tab has a removable adhesive disposed thereon for repeatedly adhering to and removing from the surface of the container. In addition, it is an advantage of the present invention to provide a base layer having an adhesive disposed thereon for permanently or removably adhering the multilayer label to the surface of the container.

Still further, it is an advantage of the present invention to provide a multilayer label having a plurality of internal layers wherein each layer is an individual and discrete layer that is each adhered to the overcoat layer. This allows the internal layers to fold away from the base layer without needing bulky folds that consequently push layers disposed above the folds out away from the base layer.

It is an additional advantage of the present invention to provide a method of making a multilayer label that greatly simplifies known methods of making labels. This allows the multilayer labels of the present invention to be produced faster and more economically than known multilayer labels.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention relates to a multilayer label that is adhered to a package or a container for communicating information to a user of the label, package or container. More specifically, the multilayer label has a plurality of internal sublayers for containing further information to a user of the multilayer label. In addition, the present invention relates to a method of making a multilayer label.

Figure 1:
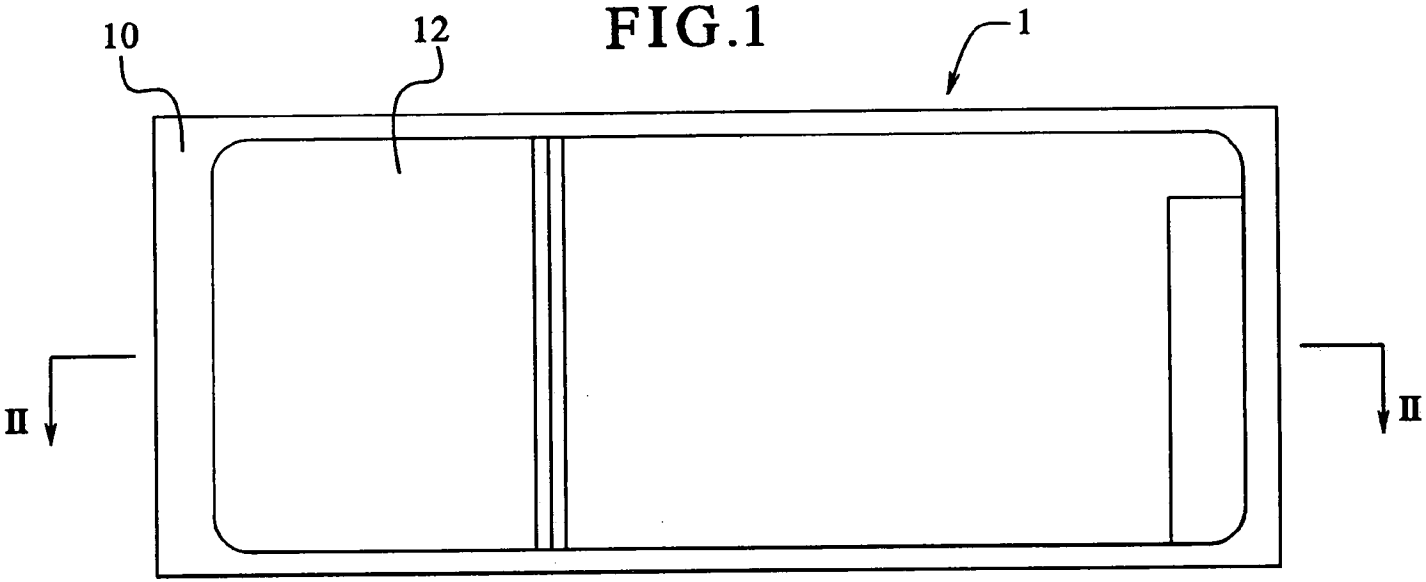
FIG. 1 illustrates a top plan view of a multilayer label in an exemplary embodiment of the present invention.

Referring now to the figures, wherein like numerals refer to like parts, FIG. 1 illustrates a top plan view of a multilayer label system 1 in an embodiment of the present invention. More specifically, the multilayer label system 1 has a backing sheet 10 for holding a multilayer label 12. The multilayer label 12 has a plurality of layers, described with specificity.

The backing sheet 10 may be made from a polymeric material that is specially designed to release an adhesive that is placed upon the backing sheet 10. Alternatively, the backing sheet 10 may have a silicone release material, or any other release material, that easily releases adhesive that is placed upon the backing sheet 10. Of course, the backing sheet 10 may further be made from any material useful as a backing material that can be removably adhered to another layer having an adhesive disposed thereon.

Figure 2:
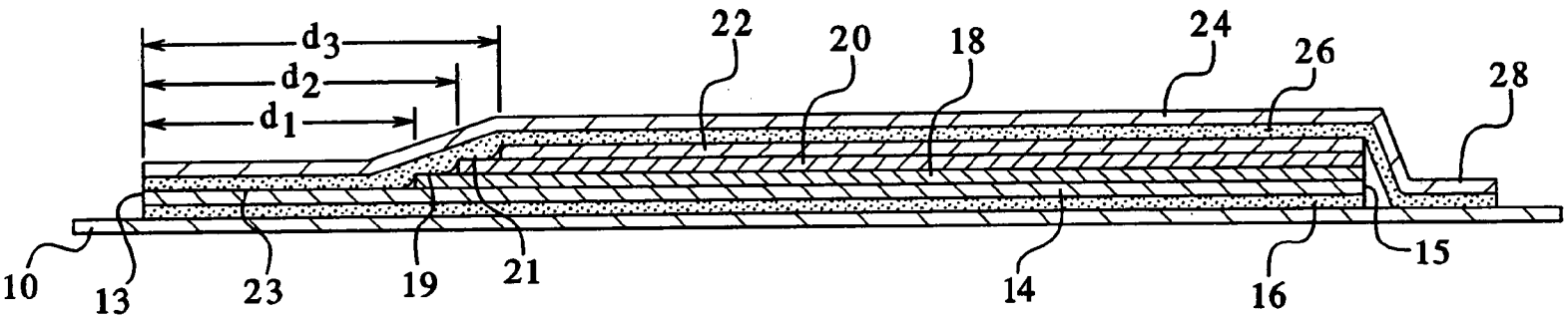
FIG. 2 illustrates a cross-sectional side view along line II—II of the multilayer label in the embodiment of the present invention.

FIG. 2 illustrates a cross-sectional side view of the multilayer label system 1, shown with reference to FIG. 1, above. The multilayer label system 1 includes the removable backing sheet 10. Further, the multilayer label system 1 may include a base layer 14 that is adhered to the backing layer 10 via an adhesive material 16. Disposed above the base layer 14 is a first sublayer 18, which is disposed across a width of the base layer 14, but is provided a distance $d_1$ from a first edge 13 of the base layer 14, and extends to a second edge 15 of the base layer 14. Disposed above first sublayer 18 is second sublayer 20, which also extends across a width of the base layer, but is provided a distance $d_2$ from the first edge 13 of the base layer 14, such that $d_2$ is longer than $d_1$. Moreover, the sublayer 20 extends to the second edge 15 of the base layer 14. Disposed above the second sublayer 20 is a top layer 22, which also extends across a width of the base layer, but is provided a distance $d_3$ from the first edge 13 of the base layer 14, such that $d_3$ is longer than $d_2$, which is longer than $d_1$.

When taken together, the sublayers 18 and 20 and the top layer 22 form a "stair step" configuration when viewed in a cross-section, as shown in FIG. 2. A portion 19 of the top surface of sublayer 18 is left exposed by the difference in lengths of the sublayer 18 and the sublayer 20. The length of portion 19 is $d_2$ minus $d_1$. In addition, a portion 21 of the top surface of sublayer 20 is left exposed because of the differences in lengths of the sublayer 20 and the top layer 22. The length of portion 21 is $d_3$ minus $d_2$. The "stair step" configuration allows a portion of each sublayer to be directly adhered to an overcoat layer 24, as described below.

Covering the base layer 14, the sublayers 18 and 20, and the top layer 22 is the overcoat layer 24 having an adhesive 26 disposed on a bottom surface thereof. The adhesive 26 adheres the overcoat layer 24 to the portions 19 and 21, the top surface of the top layer 22, and a portion 23 of the base layer 14. It should be noted that the length of the portion 23 of the base layer 14 is $d_1$. Because the adhesive 26 adheres the portions 19 and 21 to the overcoat layer 24, the sublayers 18 and 20, and the top layer 22 may easily fold away from the base layer 14 when the overcoat layer 24 is pulled away from the base layer 14. In addition, the overcoat layer 24 and adhesive 26 include a portion 28 that extends beyond the second edges of the base layer 14 and the sublayers 18 and 20, and the top layer 22 to adhere the overcoat layer 24 to the backing layer 10. When the backing layer 10 is removed from the multilayer label 12, the portion 28 of the overcoat layer 24 having the adhesive 26 may be removably adhered directly to a package or container surface.

The overcoat layer 24 may be made from a polymeric material that protects the base layer 14, the sublayers 18 and 20, the top layer 22, and the adhesive layers 16 and 26. although any material may be utilized for the overcoat layer 24 as may be apparent to one having ordinary skill in the art. Alternatively, the overcoat layer 24 may be printed, or otherwise marked with information. Preferably, the overcoat layer 24 is clear, so that information printed on a top surface of the sublayer 22, and the exposed portion 23 of the base layer 14 may be seen by a user of the label, package or container.

Of course, it should be noted that the number of sublayers contained between the base layer 14 and the top layer 22 should not be limited as herein described. Any number of sublayers may be included to form any number of exposed surfaces for information to be printed thereon. Moreover, the length of each portion of each sublayer that is adhered to the overcoat layer 24 via the adhesive 26 should also not be limited, as the portions can be any size. Moreover, the multilayer labels 1 can be any size to fit any container or package.

Figure 3:
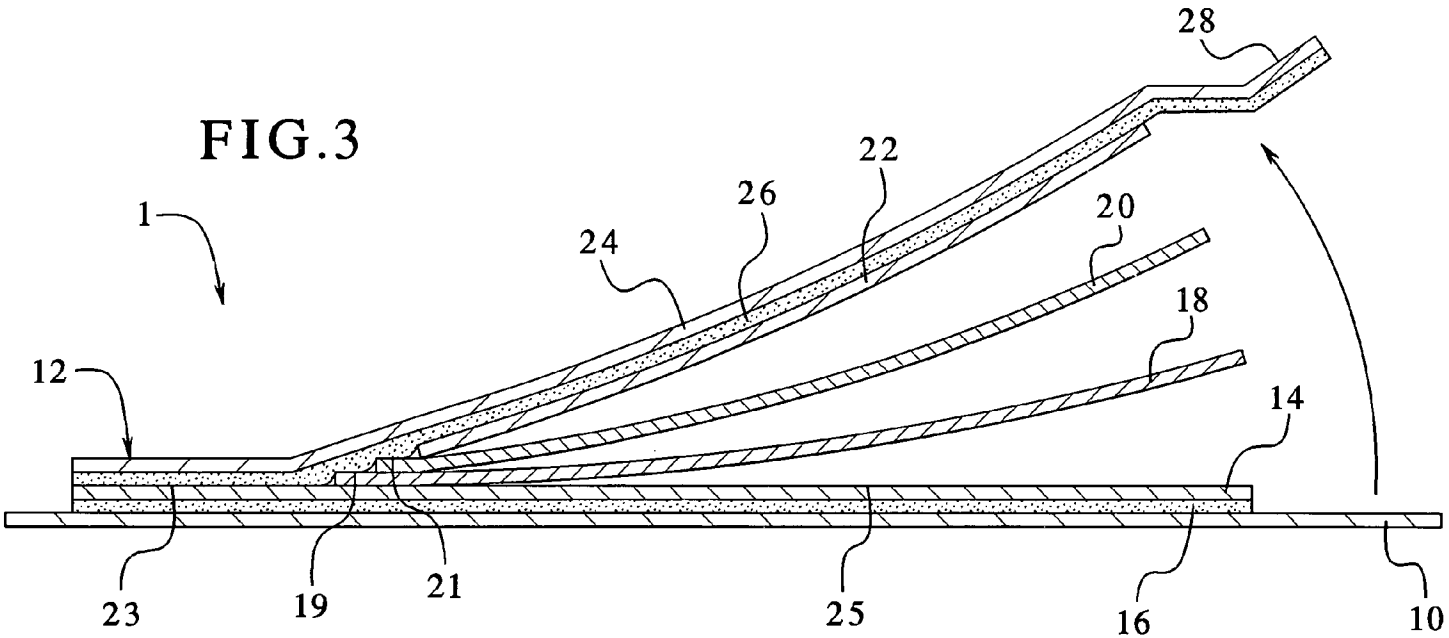
FIG. 3 illustrates a side view of the multilayer label of the present invention having a portion of an overcoat layer removed from a backing layer and swung away from the remainder of the label.

FIG. 3 illustrates a side view of the multilayer label system 1 with the portion 28 of the overcoat layer 24 removed from the backing layer 10, so that the overcoat layer 24 can be swung away from the remainder of the label system 1. Sublayers 18 and 20 and top layer 22 are exposed when the overcoat layer 24 is swung away from the base layer 14. As shown in FIG. 3, the portion 23 of the top surface of the base layer 14, the first and second portions 19 and 21 of the sublayer 18 and 20, respectively, and the top surface of the top layer 22 are all adhered to the overcoat layer 24. When the portion 28 of the overcoat layer 24 is swung away from the base layer 14 (or a package or container, as illustrated below with reference to FIGS. 6 and 7), the bottom surface of the top layer 22, the top and bottom surfaces of the sublayers 18 and 20, and the remaining portion 25 of the base layer 14 are all exposed. These surfaces may contain information, such as directions, coupons, warnings, or any other information that can be exposed when the overcoat layer 24 is swung away from the base layer 14.

Figure 4:
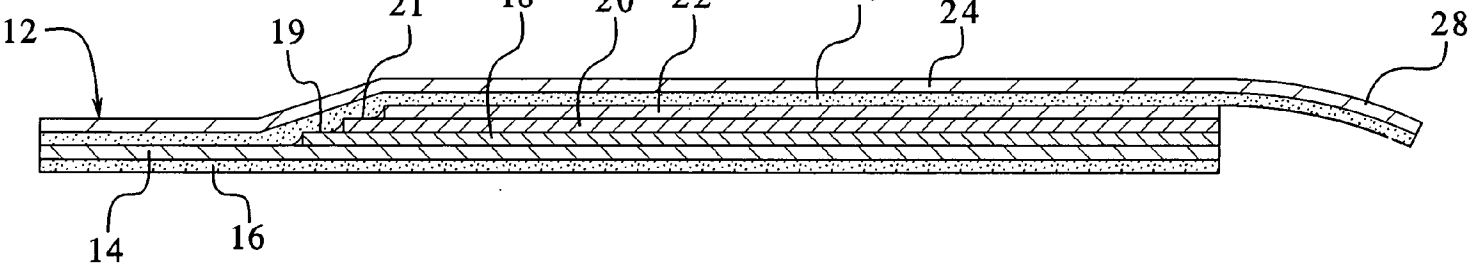
FIG. 4 illustrates a side view of the multilayer label with a backing layer removed thereby exposing an adhesive.
Figure 6:
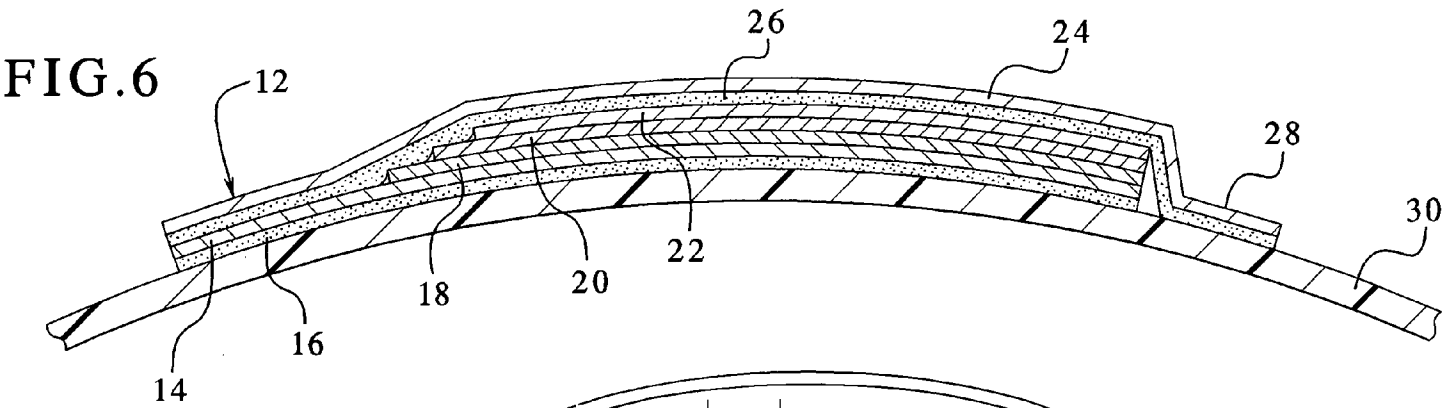
FIG. 6 illustrates a cross-sectional side view of the multilayer label along line VI—VI shown in FIG. 5 in an embodiment of the present invention.
Figure 5:
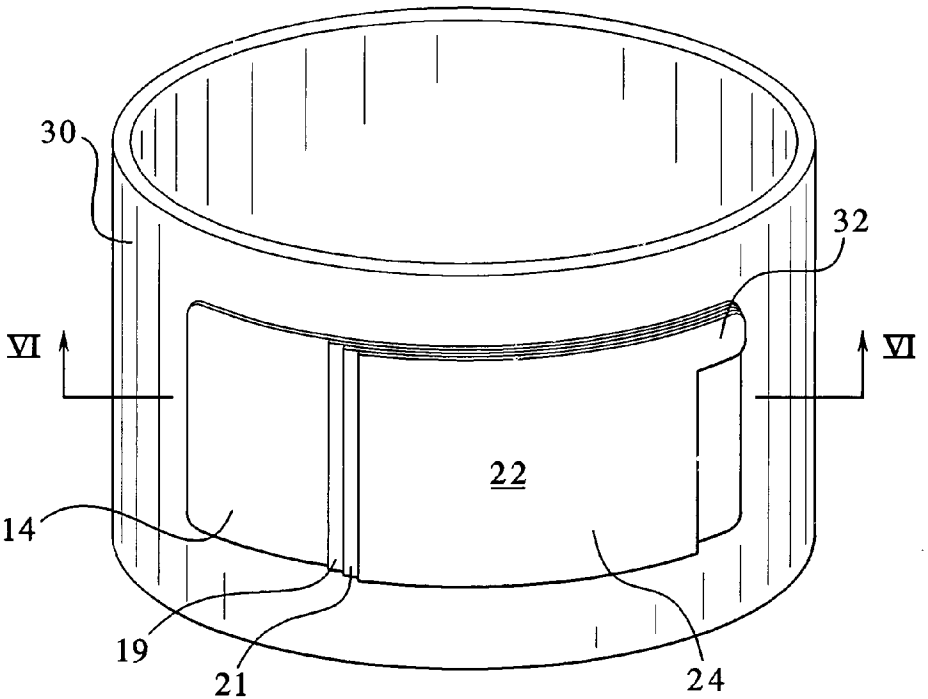
FIG. 5 illustrates a perspective view of a multilayer label of the present invention adhered to a container.

FIG. 4 illustrates the multilayer label 12, which represents the multilayer label system 1 with the backing layer 10 removed from the base layer 14 and the portion 28 of the overcoat layer 24. FIG. 5 illustrates the multilayer label 12 whereby the adhesive layer 16 on the bottom surface of the base layer 14 and the portion 28 of the overcoat layer 24 are adhered to a surface of a container 30. FIG. 6 illustrates a cross-sectional view along line VI—VI of FIG. 5 and showing the multilayer label 12 adhered to the bottle 30 via the adhesive layer 16 and the adhesive 26 on the portion 28 of the overcoat layer 24. It should be noted that the portion 28 of the overcoat layer 24 is removably adhered directly to the surface of the container 30. However, the portion 28 of the overcoat layer 24 includes a tab 32 that is an extension of the top layer 22 to cover the adhesive 26. The tab 32 may be gripped by a user of the label 12 to pull the portion 28 of the overcoat layer 24, and hence the top layer 22, from the base layer 14, thereby exposing the surfaces of the sublayers 18 and 20, top layer 22, and the portion 25 on the top surface of the base layer 14, as illustrated in FIG. 7.

Figure 7:
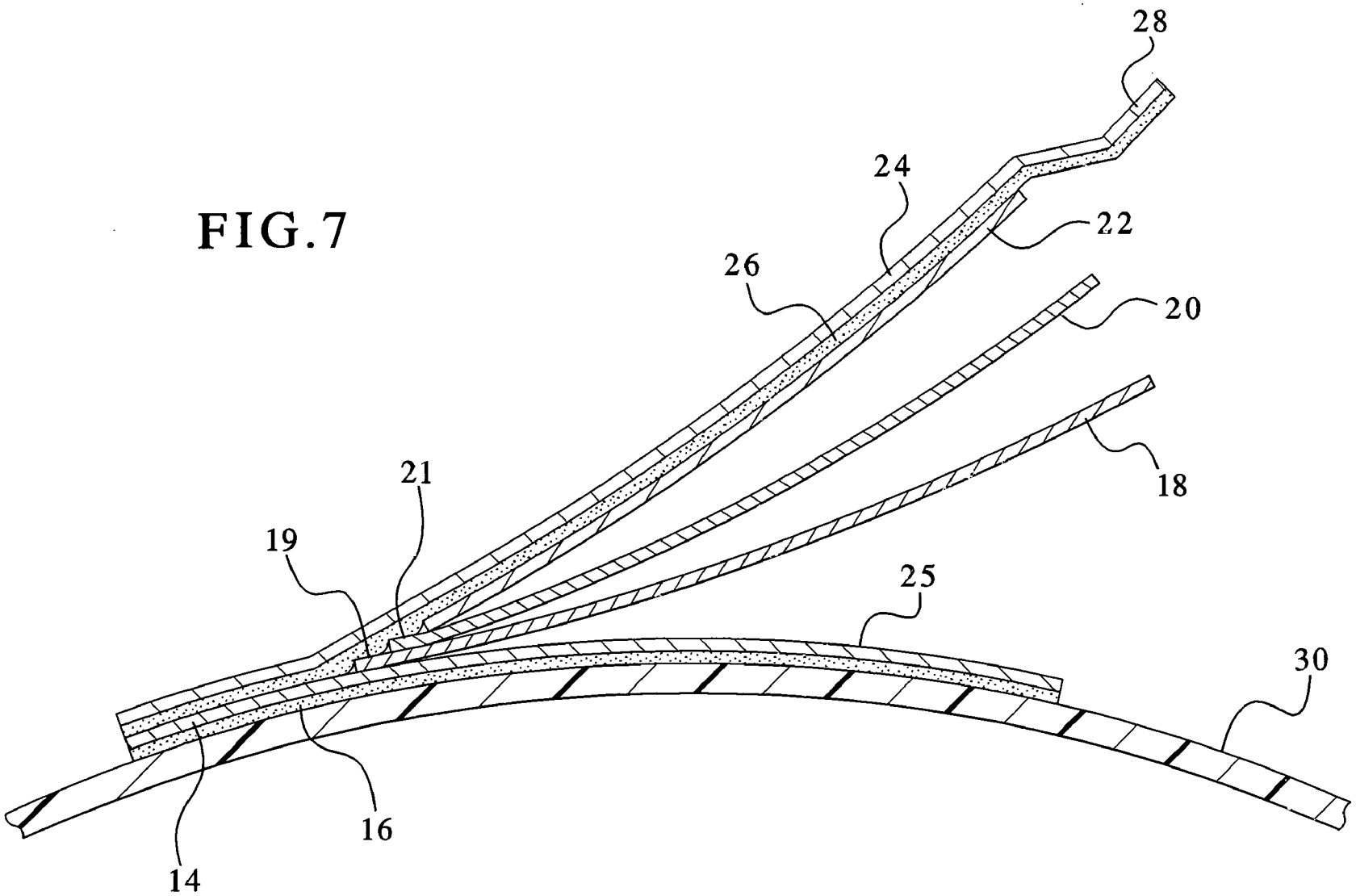
FIG. 7 illustrates a side view of the multilayer label adhered to a container having a portion of the overcoat layer removed from the container and swung away from the remainder of the label.

A noted, FIG. 7 illustrates a side view of the multilayer label 12 having the portion 28 of the overcoat layer 24 removed from the surface of the container 30 and swung away from the container 30 thereby exposing the surfaces of the sublayers 18 and 20, the top layer 22, and the remaining portion 25 of the base layer 14. Because the adhesive layer 26 adheres the overcoat layer 24 and the portions 19 and 21, the sublayers 18 and 20 are easily swung away from the base layer 14 to expose the surfaces of the sublayers 18 and 20, the top layer 22, and the portion 25 of the base layer 14.

Figure 8:
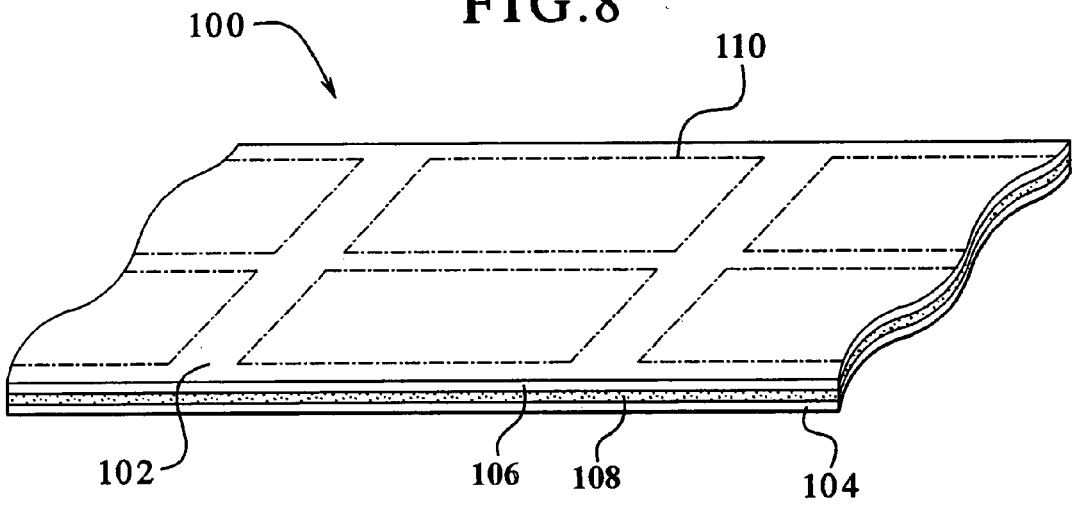
FIG. 8 illustrates a perspective view of a base layer adhered to a backing layer in an embodiment of a method of making the present invention.

FIGS. 8–16 illustrate a method of making the multiple layer labels of the present invention, as described above with reference to FIGS. 1–7. More specifically, FIG. 8 illustrates a web 100 of a multiple layer base system 102. The base system 102 comprises a backing layer 104 that contains a silicone material, or some other adhesive release material, on the top surface of the backing layer 104. Moreover, the base system 102 includes a base layer 106 having an adhesive 108 disposed on a bottom surface of the base layer 106. The adhesive 108 may be a pressure sensitive adhesive, or any other comparable adhesive, that adheres the base layer 106 to the backing layer 104. Of course, the base layer 106 is removable from the backing layer 104 because of the silicone or adhesive release material disposed on the top surface of the backing layer 104.

Printed on or otherwise disposed on the top surface of the base layer 106 may be indicia 110, such as printing, symbols, or other information. The information typically relates to instructions on how to use the multiple layer label, the container that the label is disposed on, or the contents of the container. Of course, any other information may be provided on the base layer 106 as may be apparent to one having ordinary skill in the art. Generally, the indicia may form an outline of the finished label, or may provide some other indication as to the shape of the finished label. Of course, the printing should only be on the base layer 106 in areas that will become part of the finished label. Alternatively, printing may take the form of marks, lines, or other like information to inform where other features, such as the folded insert, as described below, should be placed.

Figure 9:
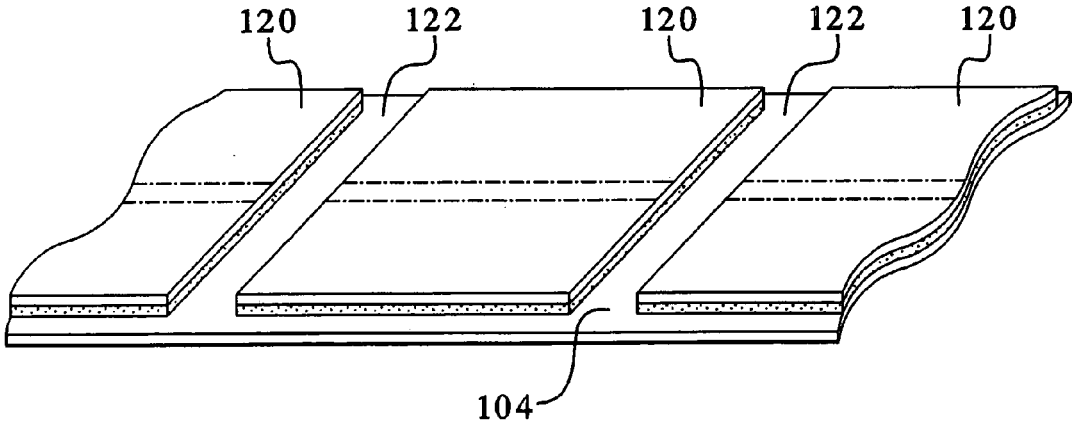
FIG. 9 illustrates a perspective view of base layer portions in the embodiment of the method of making the present invention.

FIG. 9 illustrates the base system 102 having been die cut so that base layer sections 120 are left adhesively attached to the backing layer 104. In this example, each base layer section 120 is utilized to make two finished labels. Of course, any number of finished labels may be produced via the base layer sections 120. A space 122 is thereby produced between each base layer section 120.

Figure 10:
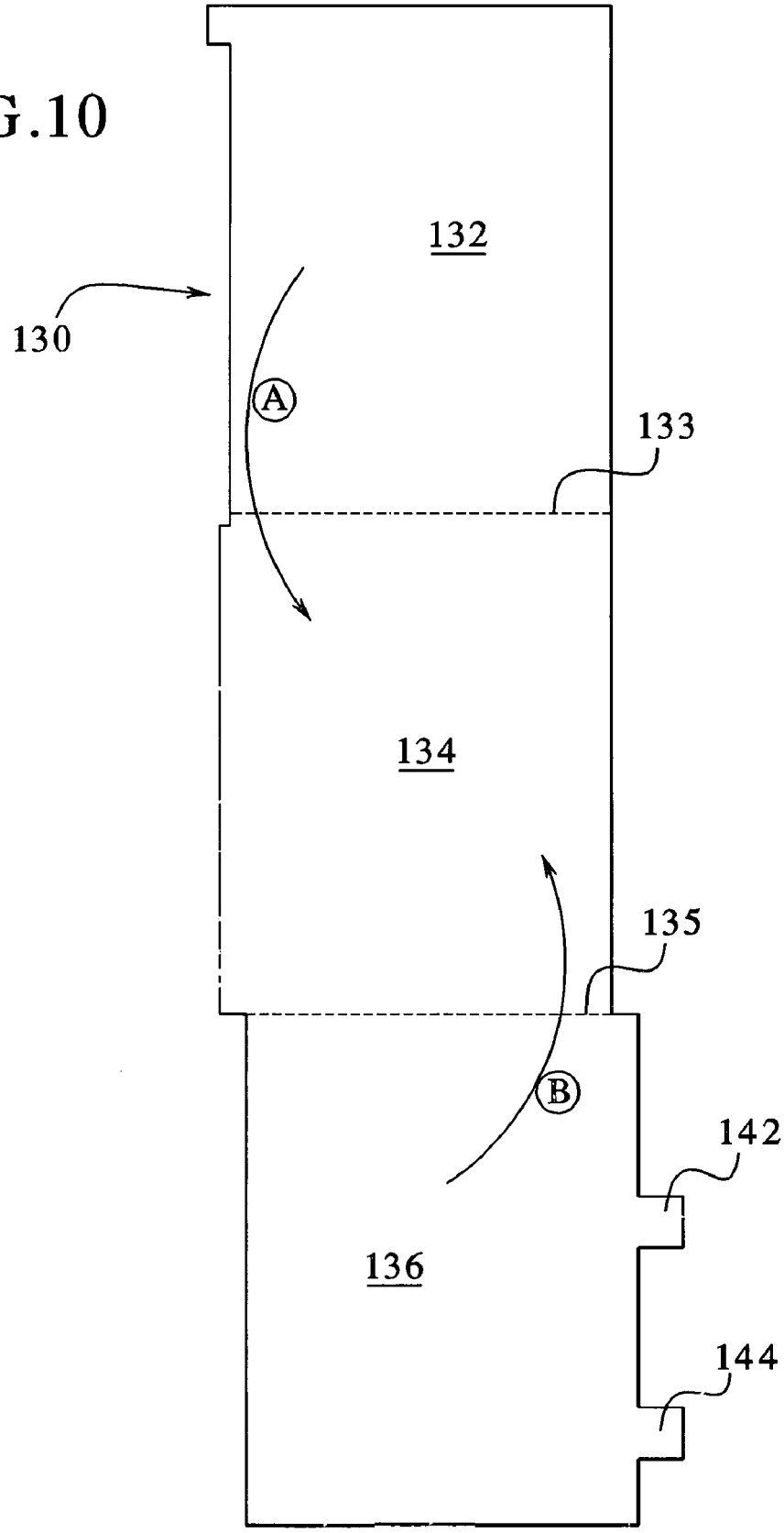
FIG. 10 illustrates a top view of an insert piece in the embodiment of the method of making the present invention.
Figure 11:
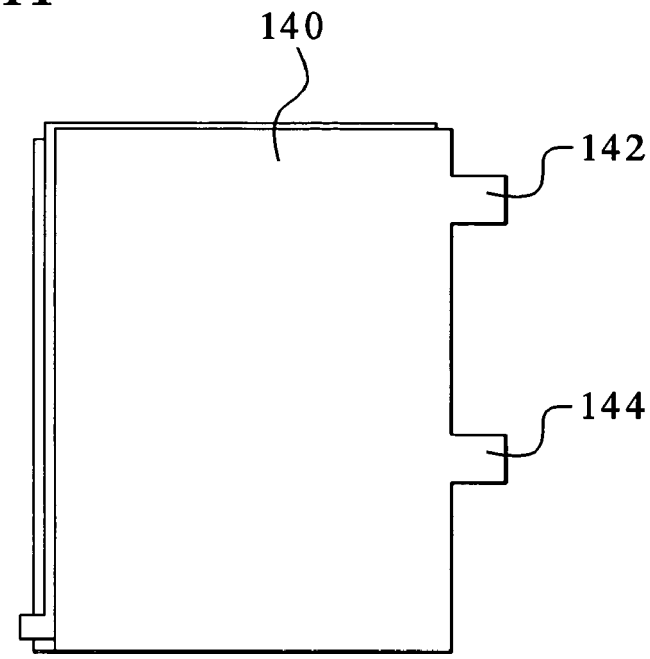
FIG. 11 illustrates a top plan view of a folded insert in the embodiment of the method of making the present invention.
Figure 12:
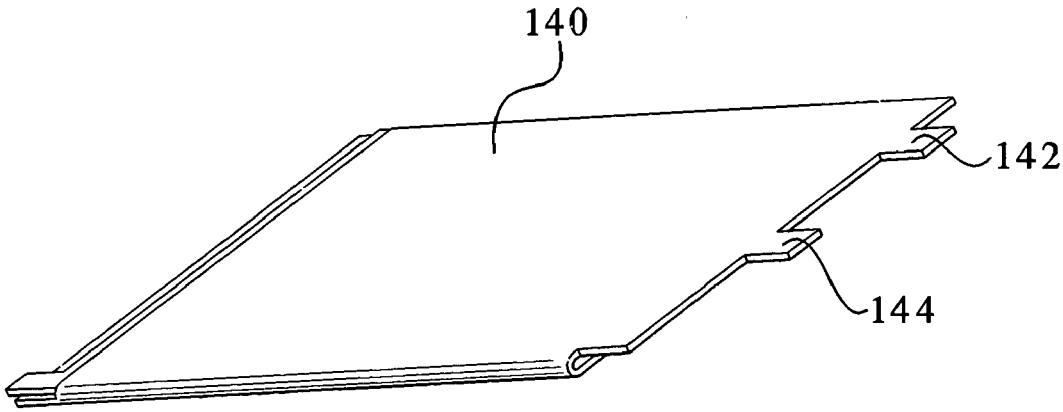
FIG. 12 illustrates a perspective view of the folded insert in the embodiment of the method of making the present invention.
Figure 13:
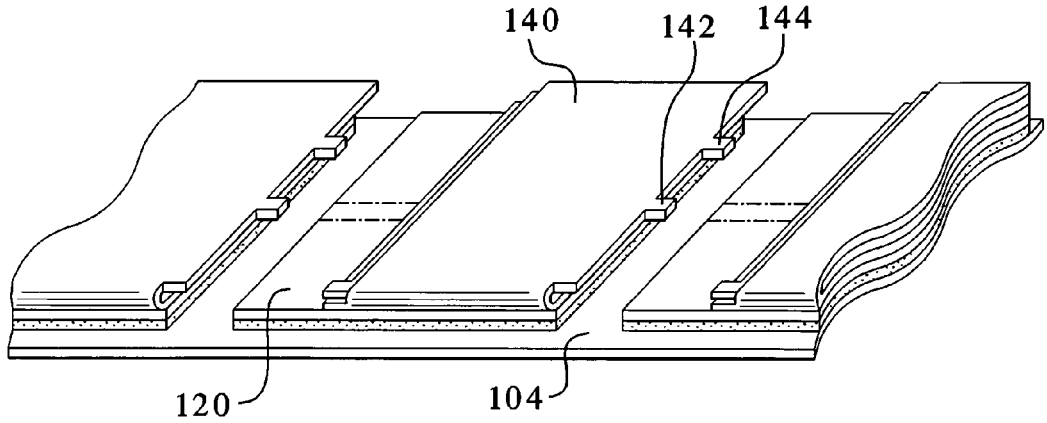
FIG. 13 illustrates a perspective view of base layer portions and the folded insert disposed over the base layer portions in the embodiment of the method of making the present invention.

As illustrated in FIG. 10, an insert 130 that is placed on top of each base layer section 120 is illustrated. The insert may comprise a first section 132, a second section 134 and a third section 136 that are separated by fold lines 133 and 135, respectively. The first section 132 and the third section 136 may fold toward the second section 134 to form a folded insert 140 in directions A and V, respectively, as shown in FIG. 10. The folded insert 140 is shown from a perspective view in FIG. 12. As illustrated in FIGS. 10–12, the insert 130 and folded insert 140 contains two tabs 142 and 144 that may be utilized to grasp each multilayer label when incorporated into the multilayer label, as described below. A folded insert 140 is disposed on the top surface of each base layer section 120, as illustrated in FIG. 13. Each tab 142 and 144 extends from the base layer section 120 so that each tab is disposed directly over the backing layer 104. Each insert 130 may be printed, prior to folding, to show information thereon so that, when folded and die cut, as noted below, the information may be visible to a user of the label.

Figure 14:
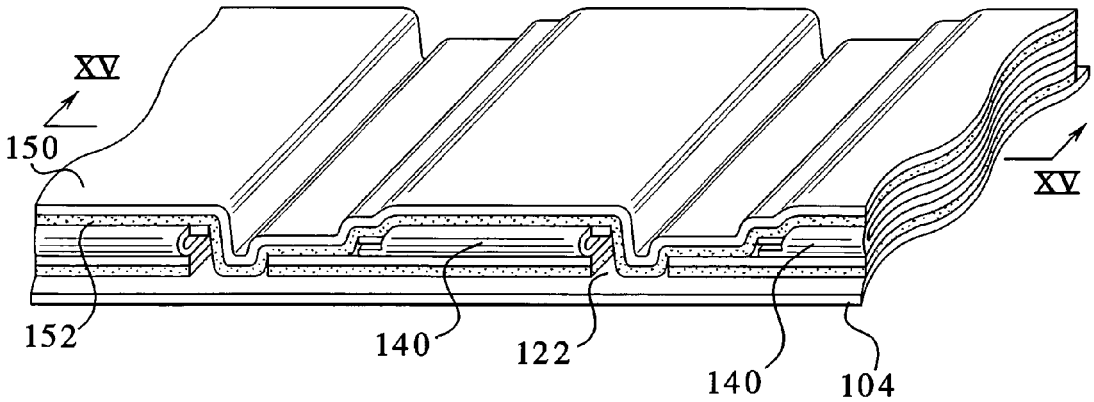
FIG. 14 illustrates a perspective view of an overcoat layer disposed over the folded insert and base layer portions in the embodiment of the method of making the present invention.

An overlaminate layer 150 having an adhesive 152 disposed on a bottom surface thereof, is illustrated in FIG. 14. The overlaminate 150 and adhesive 152 are disposed over the base layer section 120 and the folded insert 140, as well as the space 122. The overlaminate is preferably clear so that any indicia printed or otherwise provided on a top surface of the folded insert 140 or the exposed top surface of the base layer section 120 may be viewable through the overlaminate layer 150.

Figure 15:
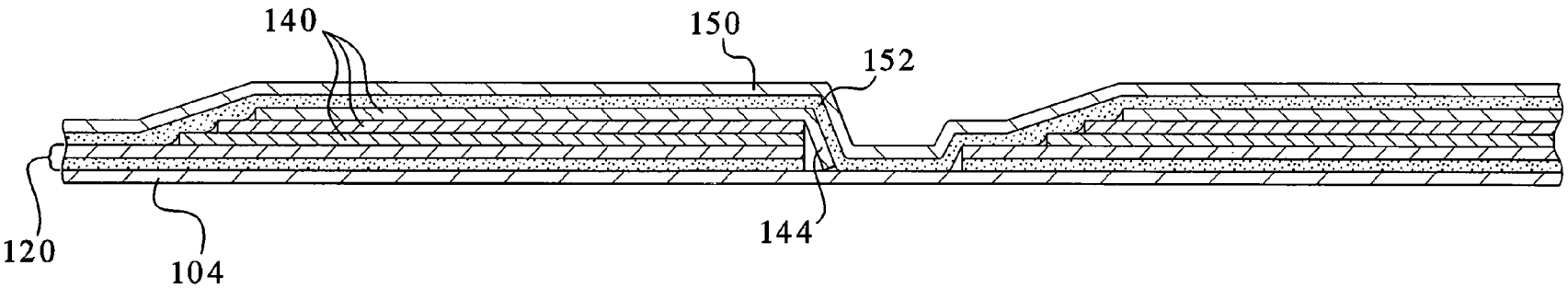
FIG. 15 illustrates a cross-sectional side view of the overcoat layer disposed over the folded insert and base layer portion along line XV—XV of FIG. 14 in the embodiment of the method of making the present invention.
Figure 16:
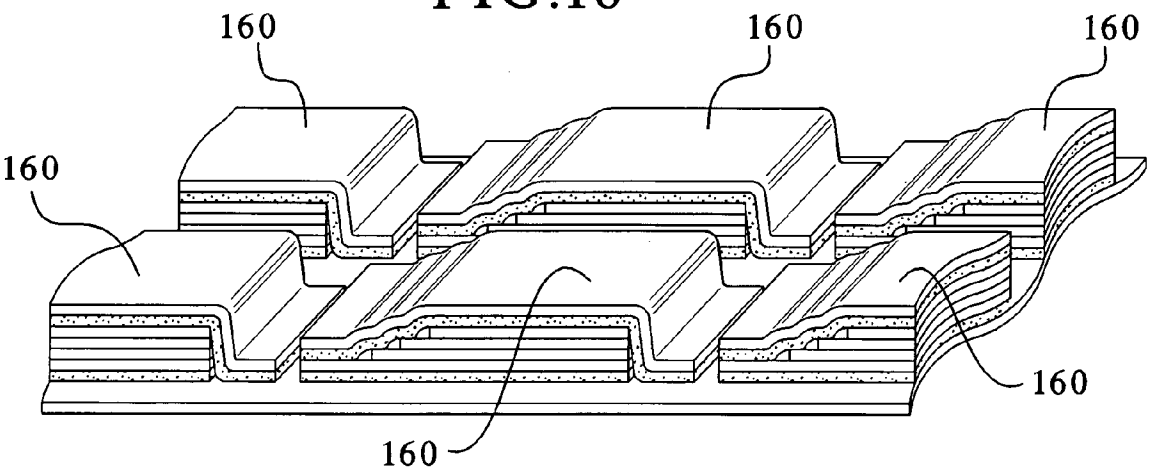
FIG. 16 illustrates a perspective view of individual multilayer labels provided on a backing in the embodiment of the method of making the present invention.

FIG. 15 illustrates a cross section of the partially finished labels as illustrated in FIG. 14. As shown in FIG. 15, the backing layer 108 is provided having the base layer sections 120 disposed thereon. The folded insert 140 is provided on the top surface of each base layer section 120. As can be seen by the cross-sectional view of FIG. 15, the folded insert forms the "stair-step" configuration so that the overlaminate 150 may be adhered directly to each of the sublayers, as illustrated in FIGS. 1–7. Moreover, the tab 144 is shown disposed directly over the backing layer 104 thereby keeping the adhesive 152 from contacting the backing layer 104 where the tab 144 is located thereby keeping the adhesive 152 from contacting a container when the multilayer label is disposed thereon.

The partially finished labels, having the base layer section 120, the folded insert 140 and the overlaminate 150 adhered thereto via the adhesive 152, are then die cut to form finished labels 160. The die cuts a perimeter of the finished labels 160. Portions of the base layer section 120, the folded insert 140 and the overlaminate 152 are removed thereby leaving the finished labels 160 provided on the backing layer 104. The fold lines 133 and 135 of the folded insert 140 are thereby removed by the die cutting of the partially finished labels. The backing layer 104 may then be cut to provide individual labels, as illustrated in FIG. 1.

Of course, as noted above, each label may have a plurality of internal layers, depending on the size of the insert 130 and the number of folds of the folded insert 140. For example, the multilayer label may have two, three or more internal sublayers. Moreover, the labels produced via the method described above may be any size. In addition, wherein each base layer section 120 produces two multilayer labels, more labels may be produced on each base layer section 120. Alternatively, each base layer section 120 may produce only one finished multilayer label.

It should be noted that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A multilayer label structure comprising:

a base layer having a first edge and a second edge having an adhesive disposed on a bottom surface of the base layer;

a first sublayer disposed on a top surface of the base layer;

a top layer disposed over the first sublayer; and an overcoat layer adhered to at least a portion of the top surface of the base layer, a portion of the first sublayer, and the top layer.

2. The multilayer label structure of claim 1 further comprising:

a second sublayer disposed on an upper surface of the first sublayer wherein said overcoat layer is adhered to a portion of said second sublayer.

3. The multilayer label structure of claim 2 further comprising:

a third sublayer disposed on an upper surface of the second sublayer.

4. The multilayer label structure of claim 2 wherein a first edge of said first sublayer is disposed a first distance from the first edge of the base layer.

5. The multilayer label structure of claim 4 wherein a first edge of said second sublayer is disposed a second distance from the first edge of the base layer.

6. The multilayer label structure of claim 5 wherein said second distance is greater than the first distance.

7. The multilayer label structure of claim 6 wherein said portion of said first sublayer has a length defined by the difference between the first distance and the second distance.

8. The multilayer label of claim 7 wherein said portion of said first sublayer is not covered by the second sublayer and is adhered directly to the overcoat layer.

9. The multilayer label of claim 2 wherein said top layer is disposed on a top surface of said second sublayer.

10. The multilayer label of claim 7 wherein a first edge of said top layer is disposed a distance from the first edge of said base layer.

11. The multilayer label of claim 10 wherein said third distance is greater than said second distance.

12. The multilayer label of claim 11 wherein said portion of said second sublayer has a length defined by the difference between the second distance and the third distance.

13. The multilayer label of claim 1 wherein said overcoat layer is adhered to the entire top surface of the top layer.

14. The multilayer label of claim 1 wherein said overcoat layer has a first edge and a second edge wherein said second edge extends beyond the second edge of the base layer.

15. The multilayer label of claim 14 wherein the first sublayer has a first edge and a second edge wherein the second edge of the overcoat layer extends beyond the second edge of the first sublayer.

16. The multilayer label of claim 14 wherein the top layer has a first edge and a second edge wherein the second edge of the overcoat layer extends beyond the second edge of the top layer.

17. The multilayer label of claim 16 wherein the top layer comprises a tab that extends beyond the second edge of said top layer and further wherein said tab is adhered to said overcoat layer.

18. The multilayer label of claim 1 wherein said overcoat layer has a first edge and a second edge and further wherein said first sublayer has a first edge and a second edge and further wherein said top layer has a first edge and a second edge wherein said second edge of said overcoat layer extends beyond the second edges of said base layer, said first sublayer, and said top layer to form a portion of said overcoat layer for adhering directly to a container when said label is disposed on a container.

19. The multilayer label of claim 18 wherein said top layer further comprises a tab extending beyond the second edge of said top layer wherein said tab is adhered to said portion of said overcoat layer to provide a means for grasping the overcoat layer when the overcoat layer is adhered directly to the container.

20. The multilayer label of claim 19 further comprising:

a removable backing layer disposed on the bottom surface of the base layer.

21. A method of making a multilayer label comprising the steps of:

providing a removable backing layer;

disposing a base layer having an adhesive on a bottom surface of said base layer onto the removable backing layer;

cutting said base layer to remove sections from the base layer to form base layer portions;

disposing an insert on a top surface of the base layer wherein said insert comprises at least one sublayer and a top layer;

adhesively applying an overcoat layer to directly adhere to a portion of a top surface of said base layer portion, a portion of the at least one sublayer, the top layer, and the backing layer exposed by the removal of the section of the base layer between the base layer portions; and cutting said overcoat layer, said insert, and said base layer to form individual multilayer labels.

22. The method of claim 21 wherein said base layer is cut via a die cut to form said base layer portions.

23. The method of claim 21 wherein said overcoat layer, said insert, and said base layer portion are cut via a die cut to form said individual multilayer labels.

24. The method of claim 21 wherein said base layer portion has a first edge and a second edge and said insert comprises a first sublayer, a second sublayer and a top layer wherein said overcoat layer is directly adhered to portions of said first sublayer and said second sublayer wherein said first sublayer has a first edge and a second edge wherein the first edge is a first distance from the first edge of said base layer and a first edge of said first sublayer and further wherein said second sublayer comprises a first edge and a second edge wherein the first edge of said second sublayer is a second distance from the first edge of said base layer portion, wherein said portion of said first sublayer directly adhered to said overcoat layer is defined by the difference between the first distance and the second distance.

25. The method of claim 24 wherein said top layer of said insert has a first edge and a second edge wherein said first edge of said top layer is a third distance from the first edge of said base layer portion, wherein said portion of said second sublayer directly adhered to said overcoat layer is defined by the difference in the third distance and the second distance.

26. The method of claim 21 further comprising the steps of:

providing a single piece of material; and folding said single piece of material to form the insert wherein said folds of said single piece of material constitute the at least one sublayer and the top layer of said insert prior to disposing said insert on the top surface of said base layer.

27. The method of claim 21 further comprising the step of:

printing said base layer prior to cutting said base layer into base layer portions.

28. The method of claim 21 further comprising the step of:

printing said insert prior to disposing said insert on said base layer.

29. The method of claim 21 further comprising the step of:

cutting said overcoat layer to provide an edge of said overcoat layer that extends beyond said base layer, said at least one sublayer, and said top layer.

30. The method of claim 21 further comprising the step of:

removing said backing layer from the remainder of said individual multilayer label and adhering said remainder of said individual multilayer label to a container.

31. The method of claim 30 further comprising the steps of:

providing a portion of said overcoat layer that extends beyond the edge of said base layer, said at least one sublayer, and said top layer; and adhering said portion of said overcoat layer directly to said container.

* * * * *